US009050801B2

(12) United States Patent
Watanabe

(10) Patent No.: US 9,050,801 B2
(45) Date of Patent: Jun. 9, 2015

(54) LIQUID EJECTING HEAD, LIQUID EJECTING APPARATUS, AND METHOD FOR MANUFACTURING LIQUID EJECTING HEAD

(75) Inventor: Eiichiro Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 65 days.

(21) Appl. No.: 13/365,205

(22) Filed: Feb. 2, 2012

(65) Prior Publication Data

US 2012/0200638 A1 Aug. 9, 2012

(30) Foreign Application Priority Data

Feb. 4, 2011 (JP) ..... 2011-022568

(51) Int. Cl.

| | |
|---|---|
| ***B41J 2/15*** | (2006.01) |
| ***B41J 2/175*** | (2006.01) |
| ***B41J 2/14*** | (2006.01) |

(52) U.S. Cl.

CPC .... *B41J 2/14274* (2013.01); *B41J 2002/14362* (2013.01)

(58) Field of Classification Search

None

See application file for complete search history.

(56) References Cited

U.S. PATENT DOCUMENTS

| | | | | |
|---|---|---|---|---|
| 6,139,132 | A | 10/2000 | Yasukawa et al. | |
| 6,332,671 | B1 * | 12/2001 | Takahashi et al. | 347/68 |
| 7,156,504 | B2 * | 1/2007 | Akahane | 347/70 |
| 7,510,271 | B2 * | 3/2009 | Owaki et al. | 347/68 |
| 7,934,813 | B2 * | 5/2011 | Owaki et al. | 347/68 |
| 2003/0067511 | A1 | 4/2003 | Okazawa | |

FOREIGN PATENT DOCUMENTS

| | | | |
|---|---|---|---|
| JP | 09-099557 | A | 4/1997 |
| JP | 2001-162792 | A | 6/2001 |
| JP | 2003-053968 | A | 2/2003 |
| JP | 2003/127354 | A | 5/2003 |
| JP | 2004-148509 | A | 5/2004 |

* cited by examiner

*Primary Examiner* — Stephen Meier
*Assistant Examiner* — Renee I Wilson
(74) *Attorney, Agent, or Firm* — Kilpatrick Townsend & Stockton LLP

(57) ABSTRACT

A liquid ejecting head includes a channel unit having a plurality of pressure chambers respectively communicating with a plurality of nozzles opened to a nozzle formation surface, a plurality of reservoirs for supplying liquid to the plurality of the pressure chambers, and a plurality of compliance units formed by partitioning at least a part of the surface of each reservoir opposite to the nozzle formation surface by a film member; and a head case joined to a surface of the channel unit. A concave chamber formed by depressing a part of a surface joined to the channel unit in a side opposite to the reservoir and an atmosphere opening passage whose one end communicates with the concave chamber and the other end is opened to the atmosphere are formed at the head case. The concave chamber is formed in series over the compliance units.

20 Claims, 9 Drawing Sheets

LIQUID EJECTING HEAD, LIQUID EJECTING APPARATUS, AND METHOD FOR MANUFACTURING LIQUID EJECTING HEAD

BACKGROUND

1. Technical Field

The present invention relates to a liquid ejecting head for providing a pressure change to a pressure chamber communicating with a nozzle and ejecting a liquid in a pressure chamber from the nozzle, a liquid ejecting apparatus, and a method for manufacturing the liquid ejecting head.

2. Related Art

A liquid ejecting head for ejecting liquid droplets from a nozzle by providing a pressure change to a liquid in a pressure chamber may be, for example, an ink jet recording head (hereinafter, simply referred to as a recording head) used for an image recording device such as an ink jet recording device (hereinafter, simply referred to as a printer), a colorant ejecting head used for manufacturing a color filter of a liquid crystal display or the like, an electrode material ejecting head used for forming an electrode of an organic EL (Electro Luminescence) display, a FED (Field Emission Display) or the like, a bio-organism ejecting head used for manufacturing a biochip (a biochemical element) or the like.

For example, the above recording head may be configured so that a channel unit having a series of liquid channels formed from a reservoir to a nozzle via a pressure chamber, an oscillator unit having a piezoelectric oscillator capable of changing a capacity of the pressure chamber or the like is attached to a head case made of resin material. In the recording head, a head case having a runout concave portion and an atmosphere opening path for opening the runout concave portion to the atmosphere, which are formed at a portion opposite to a compliance unit formed by partitioning a part of the reservoir, is known (for example, JP-A-2003-53968). The compliance unit is formed in a state where an opening surface of the reservoir is sealed with an elastic film so that the pressure change of the ink in the reservoir is absorbed by elastic deformation. The runout concave portion is a vacant portion with a size not disturbing the deformation of the compliance unit. In a state where the corresponding runout concave portion is hermetically sealed, there is no place for the air in the runout concave portion to leak, and so normal operation of the compliance unit is difficult. For this reason, the runout concave portion is opened to the atmosphere through the atmosphere opening path.

However, in the recording head as above, since a plurality of runout concave portions are formed corresponding to a plurality of compliance units, a plurality of atmosphere opening paths respectively communicating with each runout concave portion are formed through the head case, thereby weakening the strength of the head case. As a result, for example, when the piezoelectric oscillator is oscillated to eject an ink from the nozzle, the corresponding oscillation may be easily transferred through the head case to another piezoelectric oscillator, and this oscillation may exert an influence on the drive of the corresponding another piezoelectric oscillator. Therefore, the liquid ejection characteristics (the amount of liquid ejected from the nozzle, or flying speed of the liquid ejected from the nozzle) may vary (a so-called crosstalk problem) between the case where a single piezoelectric oscillator is driven independently and the case where a plurality of piezoelectric oscillators are driven simultaneously.

SUMMARY

An advantage of some aspects of the invention is to provide a liquid ejecting head, which may suppress the deterioration of a head case even though an atmosphere opening path is formed at the head case, a liquid ejecting apparatus, and a method for manufacturing the liquid ejecting head.

According to an aspect of the invention, a liquid ejecting head according to the present invention includes a channel unit having a plurality of pressure chambers respectively communicating with a plurality of nozzles opened to a nozzle formation surface, a plurality of reservoirs for supplying liquid to at least one of the plurality of pressure chambers, and a plurality of compliance units formed by partitioning at least a part of the surface of each reservoir opposite to the nozzle formation surface by a film member; and a head case joined to the surface of the channel unit opposite to the nozzle formation surface, wherein a concave chamber formed by depressing a part of a surface thereof, which is joined to the channel unit, in the side opposite to the reservoir and an atmosphere opening passage whose one end communicates with the concave chamber and the other end is opened to the atmosphere are formed at the head case, and wherein the concave chamber is formed in series over the plurality of compliance units.

According to this configuration, since the concave chamber is formed over the plurality of compliance units, if a single atmosphere opening passage communicating with the concave chamber is formed, there is no need to form a plurality of atmosphere opening passages. By doing so, the deterioration of the strength of the head case may be suppressed. As a result, the crosstalk caused by the deterioration of stiffness of the head case may be suppressed. In addition, since a single atmosphere opening passage is sufficient, the degree of design freedom of the liquid ejecting head may be enhanced.

In addition to the above configuration, the head case preferably has a reinforcing member provided at a joined surface side with the channel unit to reinforce the channel unit, so that the concave chamber is formed at a joined surface side of the reinforcing member with the channel unit.

According to this configuration, due to the stress generated by the deformation of another member (for example, the case where the head case body made of a resin is swollen under a high humidity environment), the deformation of the channel unit may be suppressed. In addition, the strength of the head case may be enhanced.

In addition to the above configuration, a channel resistance of a part of the atmosphere opening passage is preferably greater than a channel resistance of another part of the atmosphere opening passage.

According to this configuration, since the diffusion of gas in the atmosphere opening passage may be suppressed, it is possible to suppress the liquid in the reservoir from penetrating the film member and evaporating into the atmosphere opening passage. As a result, the variation of the liquid ejection characteristic caused by a gradual increase of the liquid in the channel unit may be suppressed.

In another aspect, a liquid ejecting apparatus according to the present invention includes the liquid ejecting head described above.

According to this configuration, since the crosstalk caused by the deterioration of the stiffness of the head case may be suppressed, the reliability of the liquid ejecting apparatus may be improved.

In further aspect, a method for manufacturing a liquid ejecting head which includes: a channel unit having a plurality of pressure chambers respectively communicating with a plurality of nozzles opened to a nozzle formation surface, a plurality of reservoirs for supplying liquid to at least one of the plurality of pressure chambers, and a plurality of compliance units formed by partitioning at least a part of the surface of each reservoir opposite to the nozzle formation surface by a film member; and a head case joined to a surface of the channel unit opposite to the nozzle formation surface, in which a concave chamber formed in series over the plurality of compliance units by depressing a part of a surface thereof, which is joined to the channel unit, in a side opposite to the reservoir and an atmosphere opening passage whose one end communicates with the concave chamber and the other end is opened to the atmosphere are formed at the head case, the method including: pressing a part of a surface of the head case at a channel unit joint surface side to a side opposite to the channel unit joint surface by a surface pushing unit to form the concave chamber; and joining the channel unit and the head case.

According to this method, a recording head having a concave chamber may be easily manufactured.

In addition to the method, the head case preferably has a reinforcing member provided at a joined surface side with the channel unit to reinforce the channel unit, and, in the pressing a part, the concave chamber is preferably formed at a joined surface side of the reinforcing member with the channel unit.

BRIEF DESCRIPTION OF THE DRAWINGS

The invention will be described with reference to the accompanying drawings, wherein like numbers reference like elements.

FIG. 7A is a plane view and FIG. 7B is a cross-sectional view taken along the line VIIB-VIIB.

FIG. 8A is a front view, FIG. 8B is a bottom view, and FIG. 8C is a side view.

DESCRIPTION OF EXEMPLARY EMBODIMENTS

Figure 1:
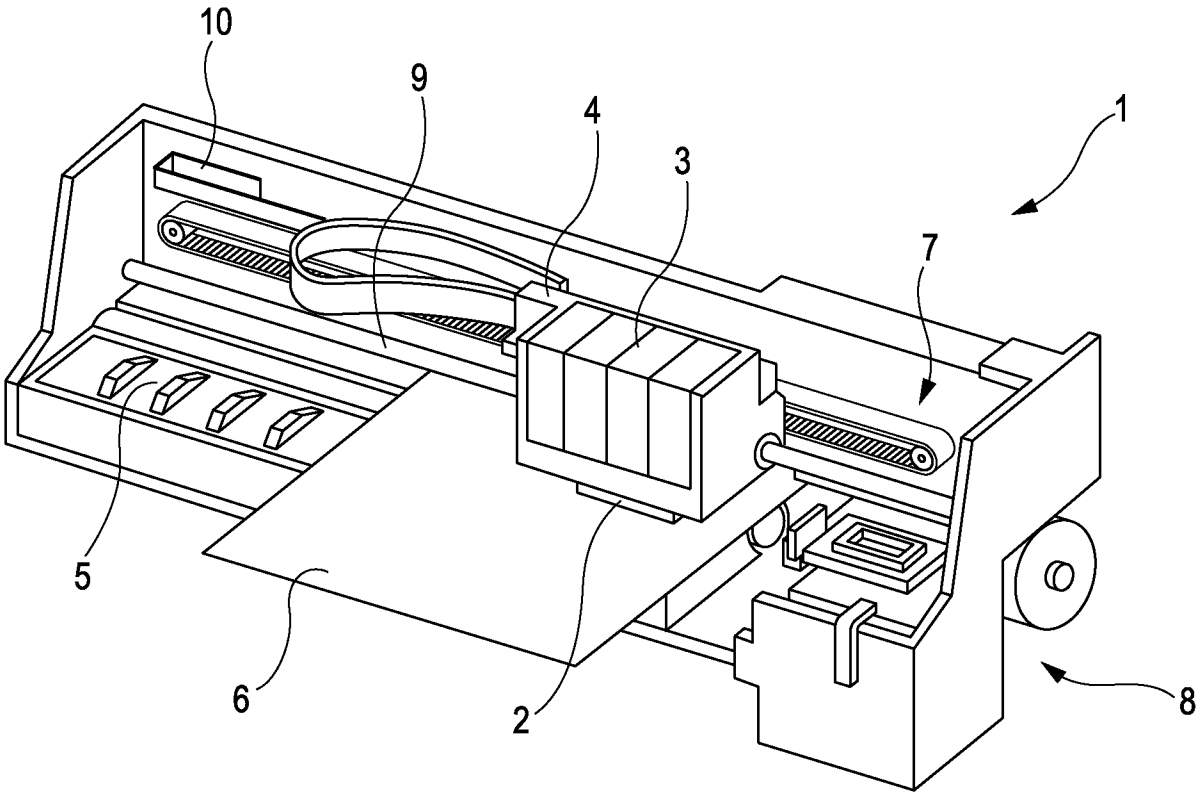
FIG. 1 is a perspective view of a printer.

Hereinafter, a best mode for implementing the present invention will be described with reference to the accompanying drawings. In addition, in the embodiment disclosed below, various limitations are provided as specific examples very suitable for the present invention, but the scope of the present invention is not limited thereto unless otherwise stated. Further, in the below, an ink jet recording device 1 (hereinafter, simply referred to as a printer) shown in FIG. 1 will be exemplified as a liquid ejecting apparatus.

The printer 1 is configured to include a carriage 4 composed of a recording head unit 2 and an ink cartridge 3 and to which an ink jet recording head unit 2 (hereinafter, simply referred to as a recording head unit) which is a kind of liquid ejecting head, a platen 5 installed to a lower portion of the recording head unit 2, a carriage moving mechanism 7 for moving the carriage 4 in a paper surface direction of a recording paper 6 (one kind of impact target on which the liquid ejected from nozzle 36 impacts), a paper carrying mechanism 8 for feeding the recording paper 6 in a paper movement direction orthogonal to the paper surface direction, or the like. Here, the paper surface direction is the main scanning direction (the reciprocation direction of the recording head unit 2), and the paper feeding direction is the vertical scanning direction (namely, a direction orthogonal to the scanning direction of the recording head unit 2).

The carriage 4 is mounted in a state of being axially supported by a guide rod 9 installed in the main scanning direction so as to move along the guide rod 9 in the main scanning direction by the operation of the carriage moving mechanism 7. The location of the carriage 4 in the main scanning direction is detected by a linear encoder 10, and the detection signal is transmitted as location information to a controller (not shown). By doing so, the controller may recognize the scanning location of the carriage 4 (the recording head unit 2) based on the location information from the linear encoder 10 and control the recording behavior (the ejection behavior) or the like of the recording head unit 2.

Figure 2:
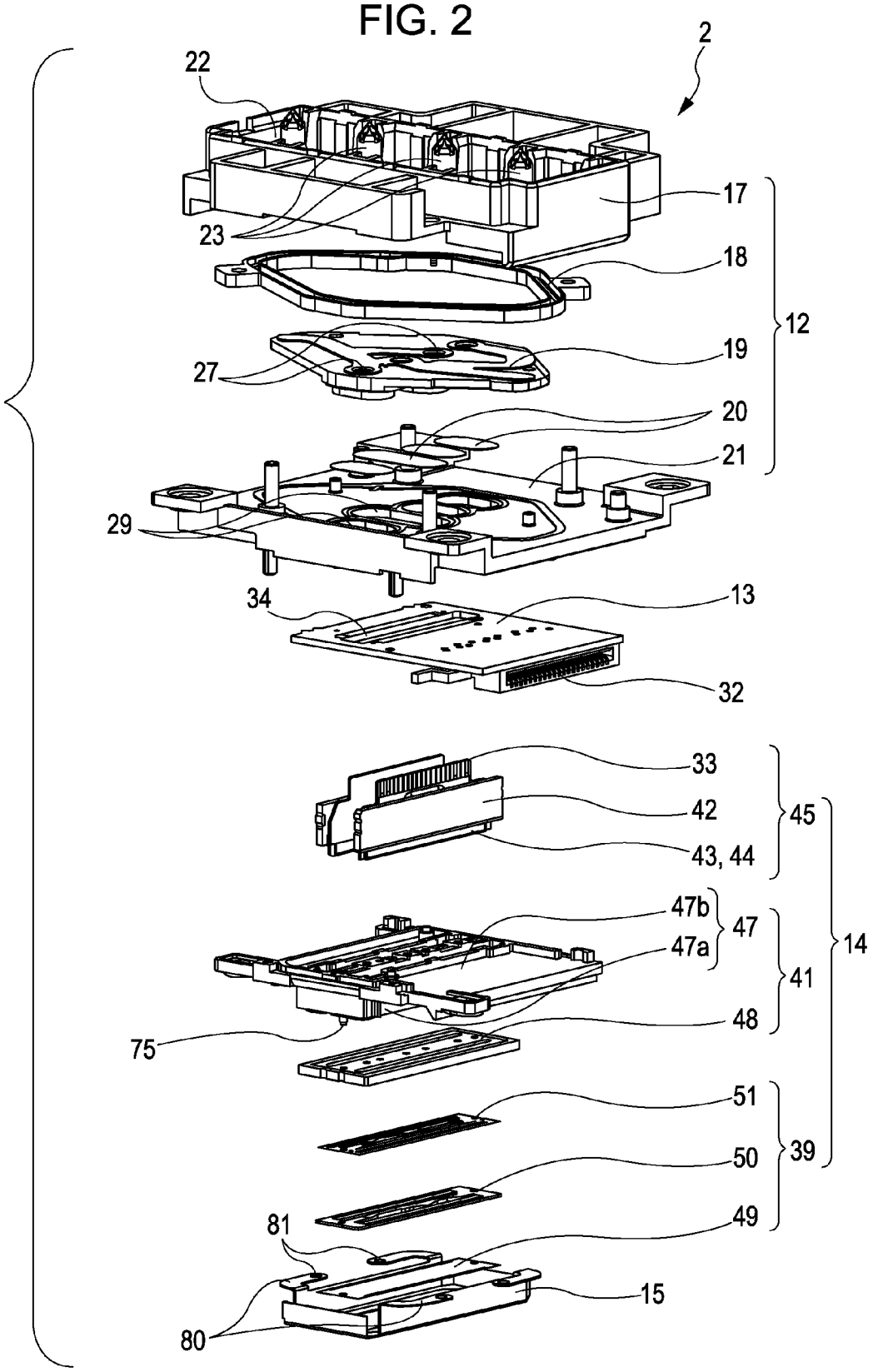
FIG. 2 is an exploded perspective view of a recording head unit.
Figure 3:
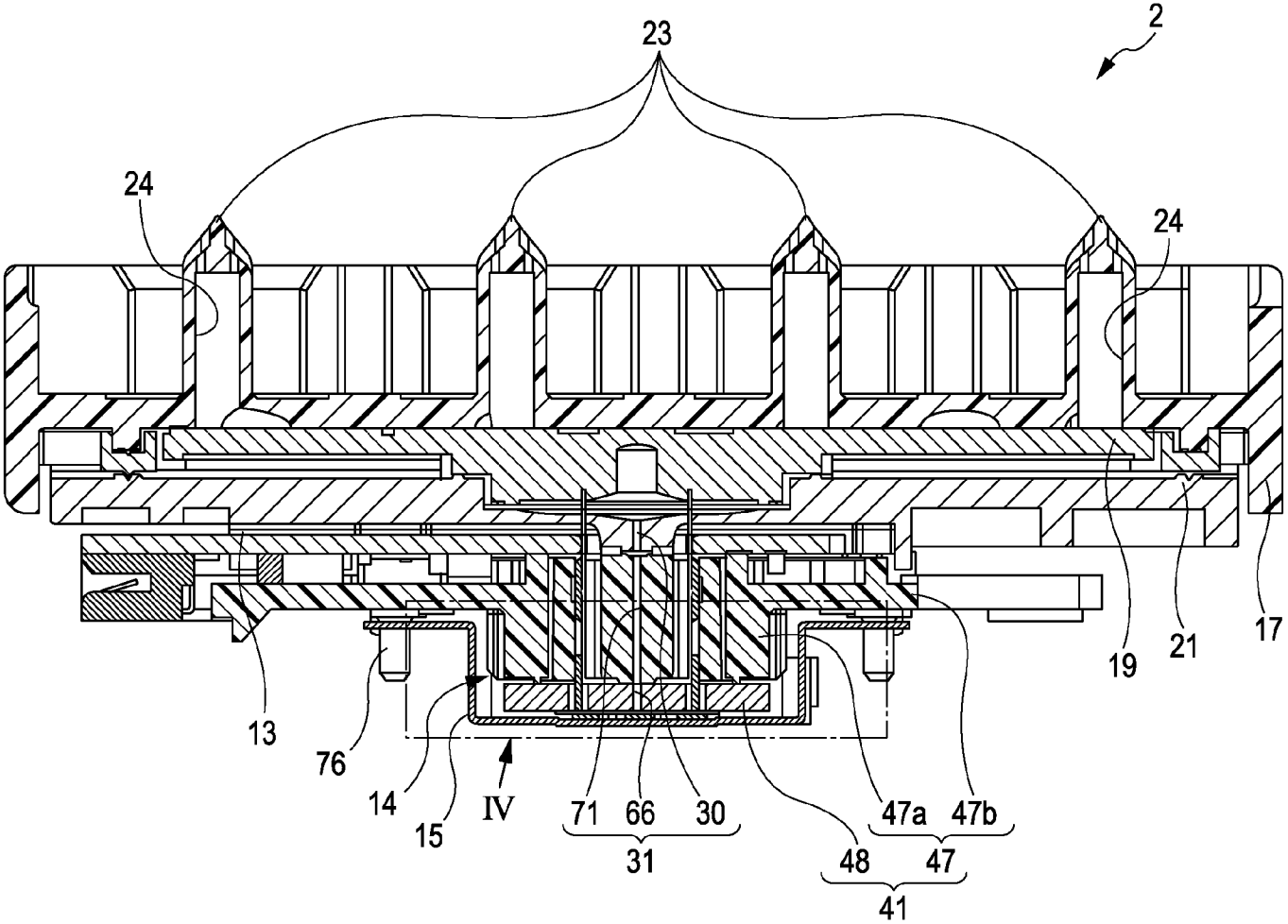
FIG. 3 is a cross-sectional view of the recording head unit.

Next, the recording head unit 2 will be described. FIG. 2 is an exploded perspective view of the recording head unit 2, and FIG. 3 is a cross-sectional view of the recording head unit 2. The recording head unit 2 of this embodiment configures a lower portion of the carriage 4 (the side toward the recording paper 6 during the recording behavior), and an ink cartridge 3 storing an ink (a kind of liquid) is detachably mounted to the upper portion. In addition, as shown in FIG. 2, the recording head unit 2 is configured to include a pedestal 12 mounted to the ink cartridge 3, a circuit board 13 provided to the lower portion of the pedestal 12, a recording head 14 mounted to the lower portion of the pedestal 12 (a side opposite to the ink cartridge 3) with the circuit board 13 being interposed between the recording head 14 and the pedestal 12, and a head cover 15 for protecting the recording head 14.

The pedestal 12 is a member configuring the upper portion of the recording head unit 2. The pedestal 12 of this embodiment is configured to include an ink introduction member 17 for introducing an ink from the ink cartridge 3, a ring-shaped seal member 18 mounted to the lower portion of the ink introduction member 17, a connection channel member 19 disposed in the seal member 18, a plurality of filters 20 mounted to the lower portion of the connection channel member 19, and an upstream base member 21 mounted to the lower portion of the connection channel member 19 with a filter 20 between the upstream base member 21 and the connection channel member 19.

The ink introduction member 17 has an ink cartridge mounting portion 22 having a surface to which a plurality of ink cartridges 3 are detachably mounted. On the bottom surface of the ink cartridge mounting portion 22, a plurality of ink introduction needles 23 are formed corresponding to each mounted ink cartridge 3. In this embodiment, four ink introduction needles 23 are installed in a row corresponding to four-color ink (for example, cyan ink, magenta ink, yellow ink, and black ink) (see FIG. 2 or the like). A channel is formed in the ink introduction needle 23 so that the corresponding channel functions as a part of the ink introduction channel 24 (see FIG. 3). In addition, by inserting the ink introduction needle 23 into the ink cartridge 3, the ink introduction channel 24 may communicate with the inside of the ink cartridge 3. By doing so, an ink may be introduced into the recording head unit 2. In addition, the lower end portion of the ink introduction channel 24 is formed to be capable of communicating with an intermediate channel 27 (described later) formed at the connection channel member 19 joined to the lower side of the ink introduction member 17.

The seal member 18 is an elastic member made of a resin or the like, whose inner surface is formed with a ring shape along the outer circumference of the connection channel member 19. The seal member 18 is interposed between the ink introduction member 17 and the upstream base member 21 to seal the surrounding of the connection channel member 19 which is identically interposed between the ink introduction member 17 and the upstream base member 21.

The connection channel member 19 is a member having a flat plate shape with four intermediate channels 27 respectively formed corresponding to four ink introduction needles 23. One end of the intermediate channel 27 communicates with the ink introduction channel 24 of the ink introduction member 17, and the other end communicates with an ink supply path 29 (described later) of the upstream base member 21 via the filter 20, respectively. Here, the filter 20 is a member mounted between the intermediate channel 27 of the connection channel member 19 and the ink supply path 29 of the upstream base member 21 so that bubbles or impurities mixed with the ink in the channel are not supplied to the ink supply path 29 together with the ink, and there are provided four filters corresponding to four channels. In addition, the filter 20 is formed to have a greater size than the ink introduction channel 24 or the channel in the recording head 14 in order to decrease the channel resistance of passing ink, and the lower end portion of the intermediate channel 27 is enlarged toward the filter 20 accordingly so that the opening diameter of its lower side has substantially the same size as the filter 20.

The upstream base member 21 is a member configuring the lower end portion of the pedestal 12, where the connection channel member 19 is mounted to the surface thereof, and the recording head 14 is joined to the lower surface thereof with the circuit board 13 being interposed therebetween. In addition, at the center of the upstream base member 21, the ink supply path 29 is formed therethrough in a plate thickness direction. The ink supply path 29 communicates with the intermediate channel 27 of the connection channel member 19 via the filter 20 at an upper side, and communicates with a case channel 70 (described later) formed at a head case body 47 of the recording head 14 at a lower side. In addition, the opening diameter of the ink supply path 29 at the upper side may be substantially the same as the filter 20 and decrease downwards. Further, the lower end of the ink supply path 29 extends downwards (to the recording head 14 side) further to the lower surface of the upstream base member 21, so as to be inserted into a channel insertion opening 34, described later, of the circuit board 13. By doing so, the lower end of the ink supply path 29 may be joined liquid-tightly to the case channel 70 with the circuit board 13 being interposed therebetween. In addition, the pedestal 12 is formed by joining the upstream base member 21 to the ink introduction member 17 with the seal member 18, the connection channel member 19 and the filter 20 being interposed therebetween. At this time, the ink introduction channel 24, the intermediate channel 27 and the ink supply path 29 communicate with each other to form a series of upstream-side ink channels. By the upstream-side ink channels, the ink in the ink cartridge 3 is sent to the recording head 14.

Further, at the upstream base member 21, a pedestal-side atmosphere opening passage 30 configuring a part of an atmosphere opening passage 31, described later, is formed in the vertical direction (see FIG. 3). The lower end of the pedestal-side atmosphere opening passage 30 extends downwards further to the lower surface of the upstream base member 21, similar to the ink supply path 29, so as to be inserted into the channel insertion opening 34 of the circuit board 13, described later. By doing so, the lower end of the pedestal-side atmosphere opening passage 30 may be joined liquid-tightly to a case-side atmosphere opening passage 71, described later, with the circuit board 13 being interposed therebetween. In addition, the upper end of the case-side atmosphere opening passage 71 communicates with a serpentine channel (not shown) formed at the surface of the upstream base member 21. The serpentine channel configures a part of the same atmosphere opening passage 31, and therefore it is formed as a thinner passage than other atmosphere opening passages 31 in order to increase the channel resistance more than that of the passages configuring other atmosphere opening passages 31. In addition, the serpentine channel bends several times (with a serpentine shape) in the surface of the upstream base member 21 till one-side end of the upstream base member 21, and is opened to the atmosphere at the corresponding end. In addition, the serpentine channel may be formed by, for example, forming a thin groove in the surface of the upstream base member 21 and sealing the surface of the groove with resin or the like.

The circuit board 13 is mounted between the pedestal 12 and the recording head 14 so that electric components such as IC and resistors are mounted on the surface thereof and simultaneously a connector 32 is formed at one-side end portion thereof. To the circuit board 13, a flexible cable 33 configuring an oscillator unit 45 of the recording head 14, described later, is joined. In addition, to the connector 32, an outer end of a signal cable (not shown) whose one end is connected to a controller of the printer 1 is connected. For this reason, drive signals or the like sent through the signal cable from the controller of the printer 1 may be supplied to the oscillator unit 45 through the circuit board 13 and the flexible cable 33. By doing so, the ejection behavior of the ink of the recording head 14 is controlled. In addition, at a place corresponding to the ink supply path 29, a channel insertion opening 34 perforated in the plate thickness direction is formed. The lower end of the ink supply path 29 is inserted into the channel insertion opening 34, and the case channel 70 of the head case body 47 is connected to the ink supply path 29 at a lower position than the circuit board 13.

Figure 4:
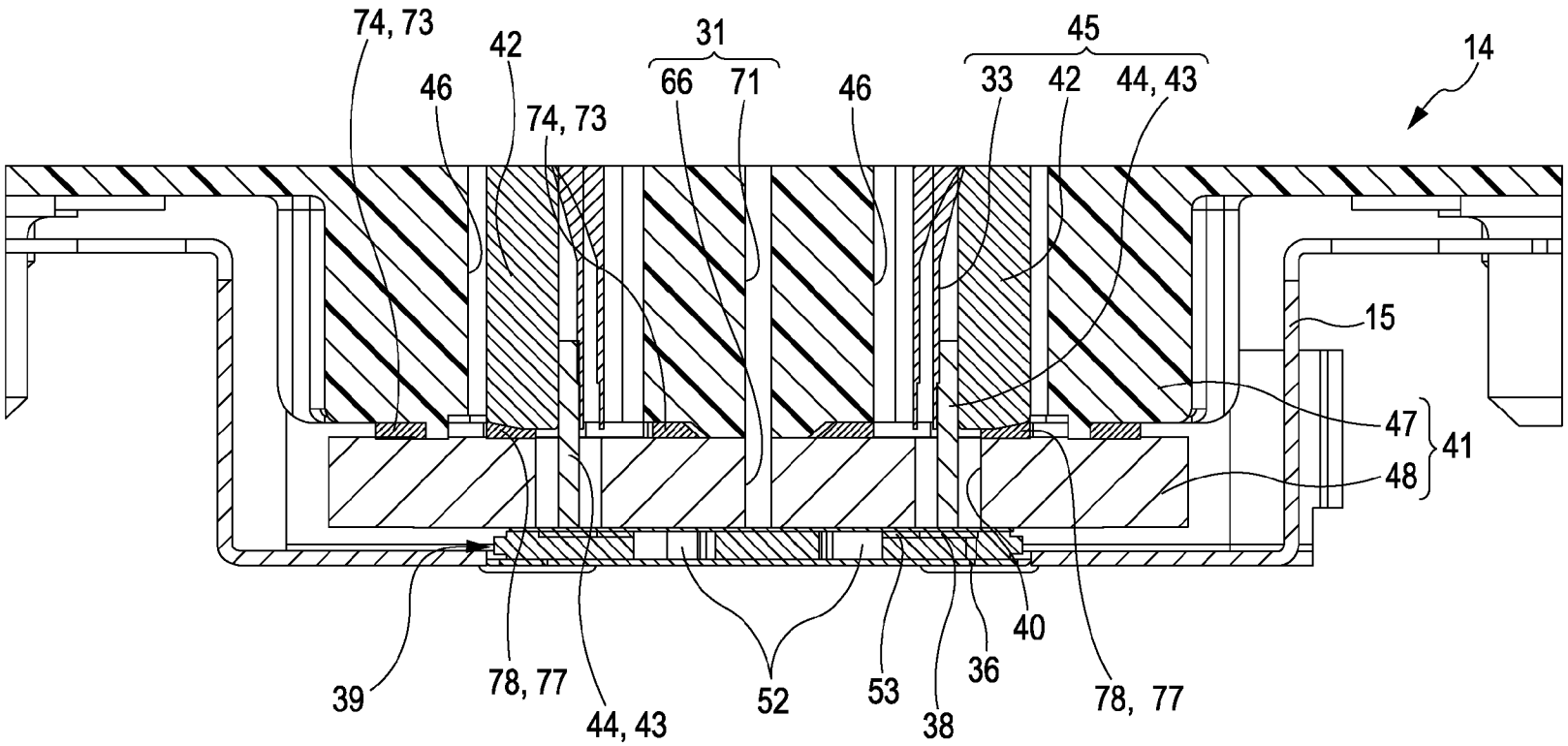
FIG. 4 is an enlarged view of a region A in FIG. 3.
Figure 5:
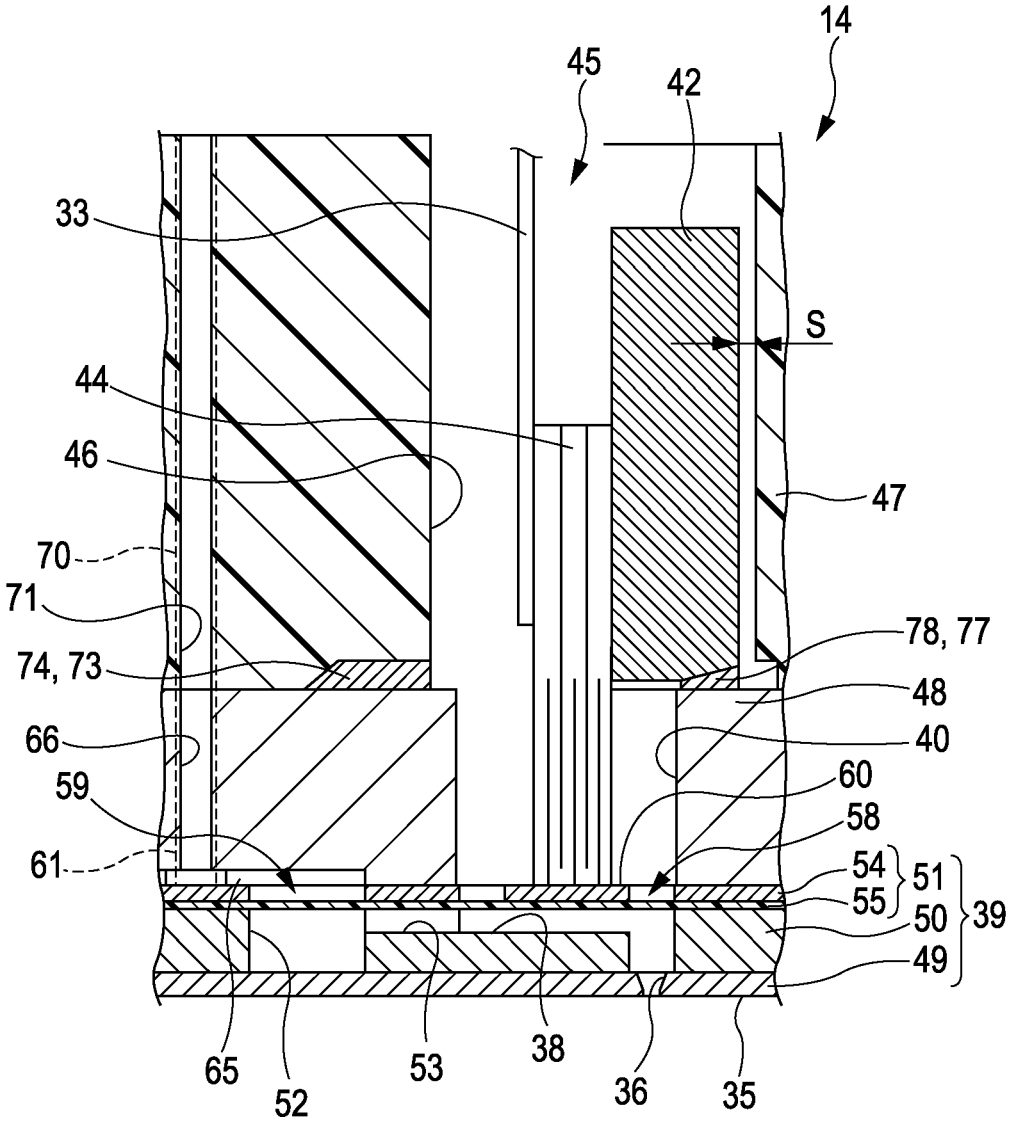
FIG. 5 is a cross-sectional view where the configuration of the recording head is more simplified and an essential part is enlarged.

Next, the configuration of the recording head 14 will be described in detail. FIG. 4 and FIG. 5 are cross-sectional views of the recording head 14, wherein FIG. 4 is an enlarged view of a region A of FIG. 3, and FIG. 5 is a cross-sectional view where the configuration of the recording head 14 is more simplified and an essential part is enlarged. The recording head 14 of this embodiment is configured to include channel unit 39 having a plurality of pressure generating chambers 38 (corresponding to the pressure chamber of the present invention) opened to the nozzle plate 49 and respectively communicating with a plurality of nozzles 36, a plurality of reservoirs (also called common liquid chambers or manifolds) 52 for supplying a liquid to at least one of the plurality of pressure generating chambers 38, and a plurality of compliance units 59 formed by portioning at least a part of each reservoir 52 at a side opposite to the nozzle plate 49 by using a film; a head case 41 joined to a side of the channel unit 39 which is opposite to the nozzle plate 49; and an oscillator unit 45 partially received in the head case 41.

First, the channel unit 39 will be described. The channel unit 39 is composed of a nozzle plate 49, a channel formation substrate 50, and an oscillation plate 51, and is formed by respectively disposing the nozzle plate 49 on one surface of the channel formation substrate 50 and disposing the oscillation plate 51 on the other surface of the channel formation substrate 50 opposite to the nozzle plate 49 so that the nozzle plate 49 and the oscillation plate 51 are laminated, and then integrating them by adhesion or the like.

The nozzle plate 49 is a thin plate made of stainless steel, where a plurality of nozzles 36 is established in a row form by a pitch corresponding to a dot-forming density. In this embodiment, for example, 180 nozzles 36 are established in a row state so that a nozzle row 37 is configured by the nozzles 36. Therefore, the lower surface of the nozzle plate 49 (the surface opposite to the channel formation substrate 50) becomes the nozzle formation surface 35 of the present invention. In addition, in the nozzle plate 49 of this embodiment, two nozzle rows 37 are provided in the main scanning direction bilaterally symmetrically in parallel.

The channel formation substrate 50 is a plate-shaped member forming a series of ink channels composed of the reservoir 52, the ink supply hole 53, and the pressure generating chamber 38. The channel formation substrate 50 of this embodiment is manufactured by etching a silicon wafer. The pressure generating chamber 38 is a chamber slim in a direction orthogonal to the row arrangement direction (a direction of the nozzle row 37) of the nozzle 36, and the pressure generating chambers 38 are formed in a plurality of rows corresponding to each nozzle 36 in a state of being portioned by a plurality of barriers. In addition, two rows of the pressure generating chambers 38 are arranged in a direction orthogonal to the nozzle row 37 (in the main scanning direction during the recording behavior) with respect to the channel formation substrate 50. The ink supply hole 53 is formed as a narrowed area with a small channel width which communicates the pressure generating chamber 38 with the reservoir 52. In addition, the reservoir 52 is a vacant portion to which the ink commonly included in the plurality of pressure generating chambers 38 is introduced. A part of the reservoir 52 extends toward the center (a location between two nozzle rows 37 in a direction orthogonal to the row arrangement direction of the nozzle 36), and therefore communicates with an ink introduction port 56, described later, established at the center portion of the oscillation plate 51. For this reason, the reservoir 52 communicates with the ink cartridge 3 via the ink introduction port 56 of the oscillation plate 51, a case channel 70 (described later) of the head case body 47, a penetrating channel 61 (described later) of the reinforcing member 48, and the upstream-side ink channel of the pedestal 12, and simultaneously communicates with each pressure generating chamber 38 via the ink supply hole 53. As a result, the reservoir 52 may supply the ink stored in the ink cartridge 3 to each pressure generating chamber 38. In addition, in this embodiment, one reservoir 52 (a right one in FIG. 6B) among two rows of reservoirs 52 corresponding to the four-color ink cartridges 3 is partitioned by barriers to be divided into three parts, so that four reservoirs 52 are formed in total, and the non-divided reservoir 52 (the left one in FIG. 6B) is allocated with a color frequently used (for example, a black ink).

The oscillation plate 51 is a composite plate having a double structure, where a resin film 55 (corresponding to a film member of the present invention) such as PPS (polyphenylene sulfide) is laminated on a support plate 54 made of metal such as stainless steel, and an ink introduction port 56 for connecting the corresponding reservoir 52 to the penetrating channel 61 of the reinforcing member 48 is formed therethrough in a vertical direction. In this embodiment, four ink introduction ports 56 corresponding to four reservoirs 52 are installed in parallel at the center (between two nozzle rows 37 in a direction orthogonal to the row arrangement direction of the nozzles 36) (see FIG. 6B). In addition, the oscillation plate 51 seals one-side passage surface of the pressure generating chamber 38 (a surface opposite to the nozzle plate 49), a diaphragm unit 58 is formed to change the capacity of the pressure generating chamber 38, and simultaneously a compliance unit 59 for sealing one-side passage surface (a surface opposite to the nozzle plate 49) of the reservoir 52 is formed. In detail, the diaphragm unit 58 is configured as shown in FIG. 5 so that a plurality of island portions 60 for joining the peak of the free end portion of a piezoelectric oscillator 44 (described later) are formed by etching the support plate 54 at a portion corresponding to the pressure generating chamber 38 and removing the corresponding portion in a ring shape. The island portion 60 has a block shape which is slim in a direction orthogonal to the row arrangement direction of the nozzle 36, similar to the planar shape of the pressure generating chamber 38, and the resin film 55 around the island portion 60 functions as an elastic film. In addition, the portion functioning as the compliance unit 59, namely the portion corresponding to the reservoir 52, composes only the resin film 55 since the support plate 54 is removed by an etching process in a passage shape similar to the reservoir 52.

Next, the head case 41 will be described. The head case 41 of this embodiment includes a head case body 47 joined to the lower surface of the pedestal 12 with the circuit board 13 being interposed therebetween, and a reinforcing member 48 fixed to the lower side of the corresponding head case body 47 (to the adhesion surface side of the channel unit 39) to reinforce the channel unit 39.

The head case body 47 includes, for example, a case unit 47*a* made of a resin such as an epoxy-based resin and having a hollow box shape, and a plate-shaped portion 47*b* formed at the upper end of the case unit 47*a* and extending from the case unit 47*a* in a lateral direction. At the lower surface of the case unit 47*a* (the surface opposite to the pedestal 12), the reinforcing member 48 is adhered and fixed. In addition, in the case unit 47*a*, a receiving void portion 46 communicating with the insertion opening 40 of the reinforcing member 48 is formed so that the oscillator unit 45 is partially received in the receiving void portion 46. In this embodiment, two rows of receiving void portions 46 are formed corresponding to two rows of insertion openings 40, and so each receiving void portion 46 receives the fixing plate 42, the upper portion of the piezoelectric oscillator group 43, and the lower portion of the flexible cable 33. In addition, the receiving void portion 46 is opened with an opening area sufficiently greater than the area of the oscillator unit 45 or the opening area of the insertion opening 40 in a planar view so that the inner wall thereof does not contact the oscillator unit 45. In particular, so that the fixing plate 42 does not contact the inner wall of the receiving void portion 46, the inner wall toward the fixing plate 42 is formed at a location back from the edge of the insertion opening 40 in a direction opposite to the fixing plate 42. By doing so, as shown in FIG. 5, between the rear surface of the fixing plate 42 (the surface opposite to the surface to which the piezoelectric oscillator group 43 is joined) and the inner wall of the receiving void portion 46, a spacing (interval) S is formed. In addition, in a state where the head case body 47 and the reinforcing member 48 are joined, a step is created between the inner wall of the insertion opening 40 and the inner wall of the receiving void portion 46, and for this reason, at the edge of the insertion opening 40, a surface to which the end surface of the fixing plate 42, described later, is joined is formed. Further, between two rows of receiving void portions 46, four case channels 70 formed through the head case body 47 in the height direction are formed in parallel. The upper end of the case channel 70 communicates with the upstream-side ink channel of the pedestal 12 (the ink supply path 29 of the upstream base member 21), and the lower end thereof communicates with the penetrating channel 61 of the reinforcing member 48. In addition, on a virtual line where the case channels 70 are installed in parallel with respect to the head case body 47, the case-side atmosphere opening passage 71 configuring a part of the atmosphere opening passage 31 is formed through the head case body 47 in the height direction. The upper end of the case-side atmosphere opening passage 71 communicates with the pedestal-side atmosphere opening passage 30 of the pedestal 12, and the lower end thereof communicates with a reinforcing member-side atmosphere opening passage 66, described later.

In addition, at a place located at the lower surface of the case unit 47*a* and facing a datum hole 63 (described later) of the reinforcing member 48, a positioning protrusion portion 75 inserted into the corresponding datum hole 63 protrudes downwards (see FIG. 2). As the positioning protrusion portion 75 is inserted into the reinforcing member 48 and the datum hole 63 of the channel unit 39, relative location of each component is defined. In addition, at the lower surface of the plate-shaped portion 47*b*, two head cover positioning units 76 are installed respectively at both sides of the case unit 47*a* of the head case body 47 (see FIG. 3). As the head cover positioning unit 76 is inserted into a head cover datum hole 81, described later, the head cover 15 is positioned with respect to the head case body 47. Further, sealant adhering portions 73 concave depressed opposite to the reinforcing member 48 are formed at the lower surface of the case unit 47*a* around the case channel 70, around the case-side atmosphere opening passage 71, and around the corresponding case unit 47*a*, and the sealant 74 is introduced thereto so that the reinforcing member 48 is adhered and fixed to the head case body 47 (see FIG. 5). By doing so, surroundings of each joining place between the case channel 70 communicating the head case body 47 with the reinforcing member 48 and the penetrating channel 61, between the case-side atmosphere opening passage 71 and the reinforcing member-side atmosphere opening passage 66, and between the receiving void portion 46 and the insertion opening 40 are sealed.

Figure 6A:
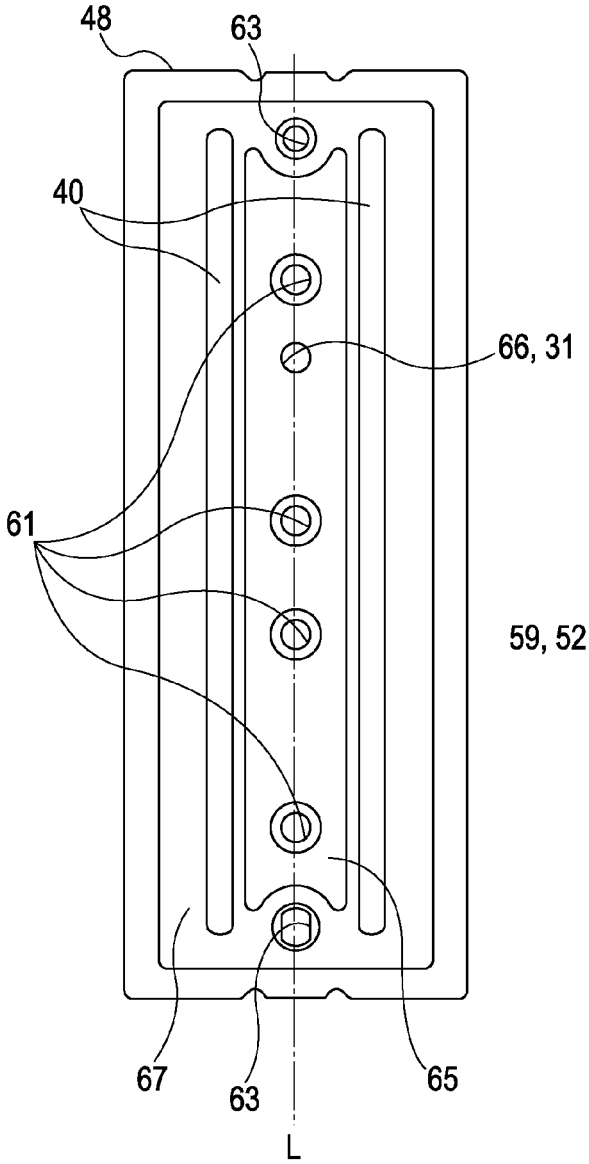
FIG. 6A is a bottom view of a reinforcing member.
Figure 6B:
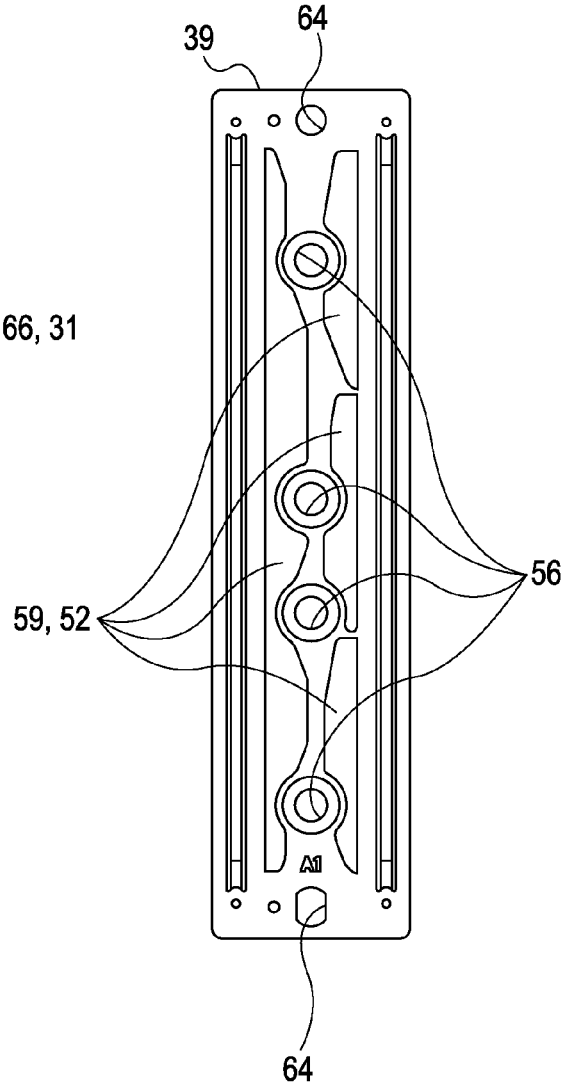
FIG. 6B is a plane view of a channel unit.
Figure 7A:
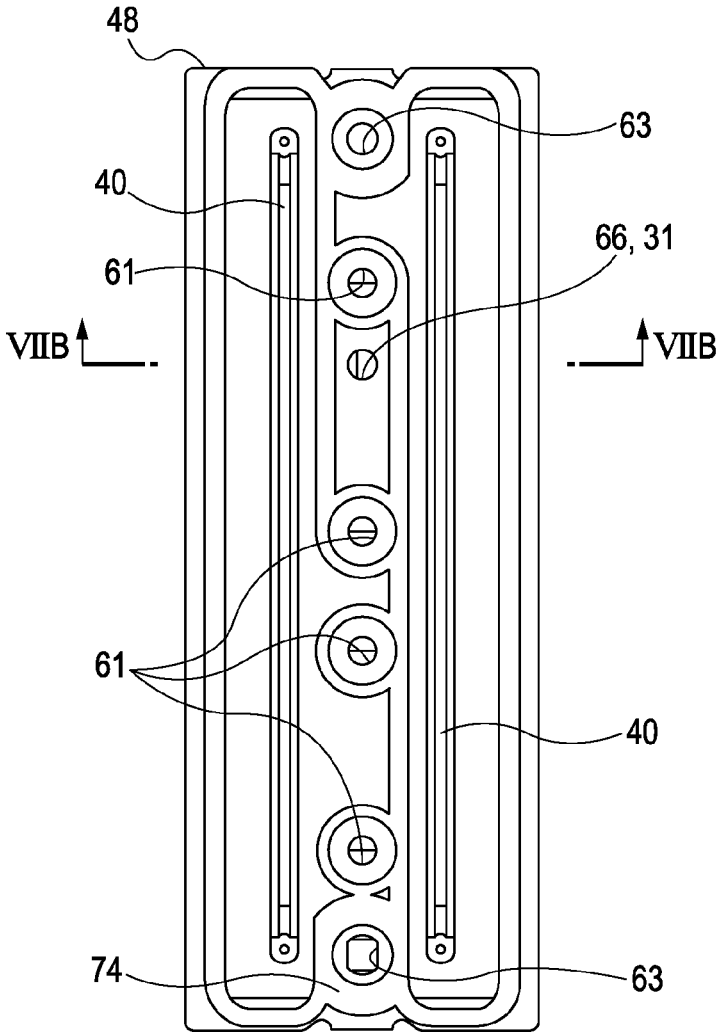
FIGS. 7A and 7B show a state where the channel unit is fixed to the reinforcing member, where
Figure 7B:
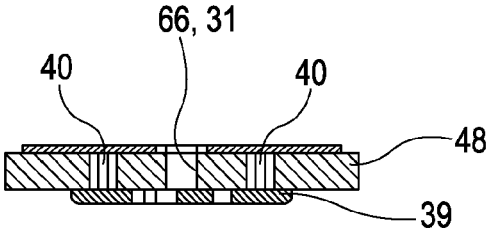
Figure 8A:
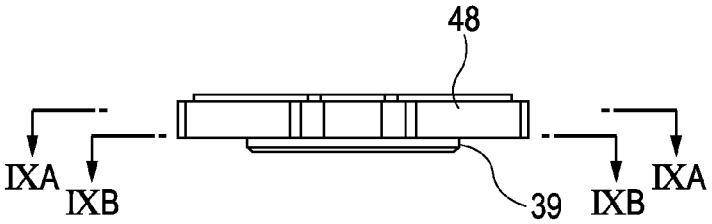
FIGS. 8A to 8C show a state where the channel unit is fixed to the reinforcing member, where
Figure 8B:
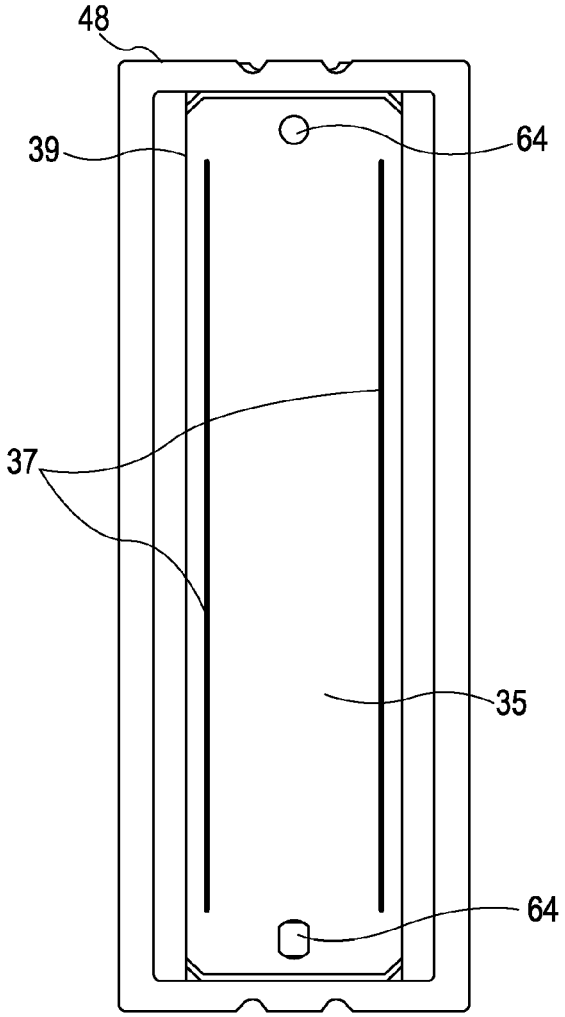
Figure 8C:
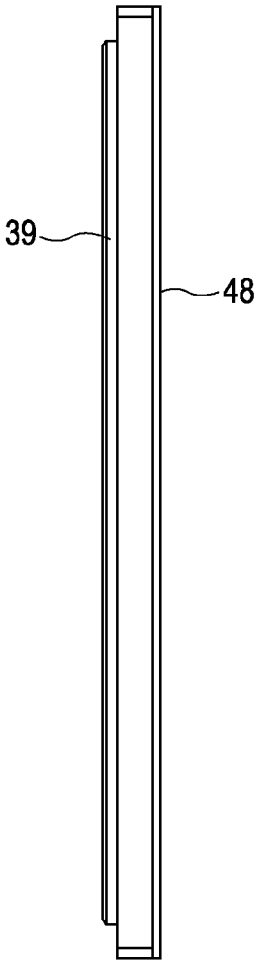
Figure 9A:
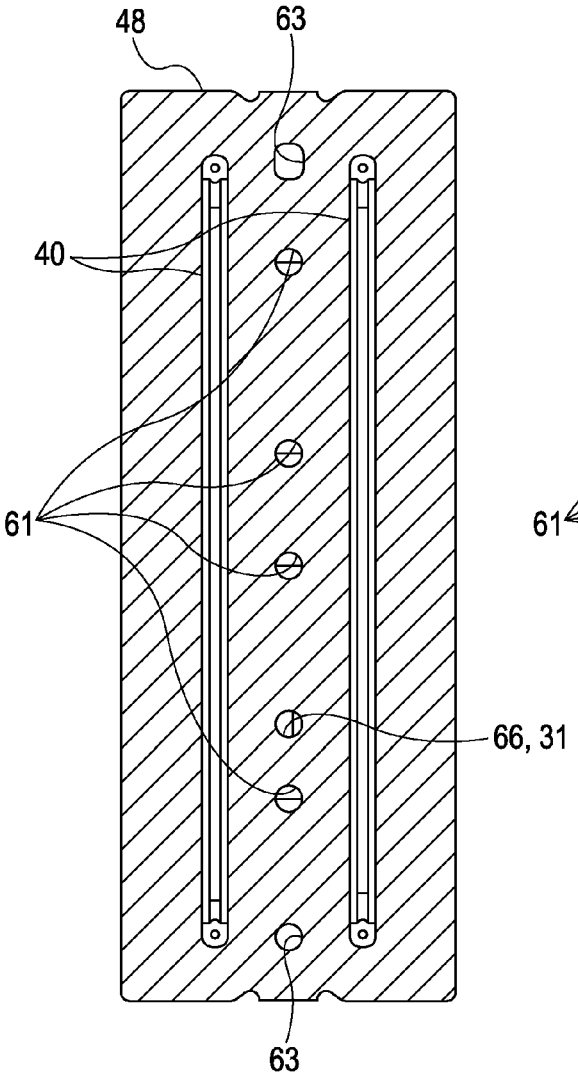
FIG. 9A is a cross-sectional view taken along the line IXA-IXA of FIG. 8A.
Figure 9B:
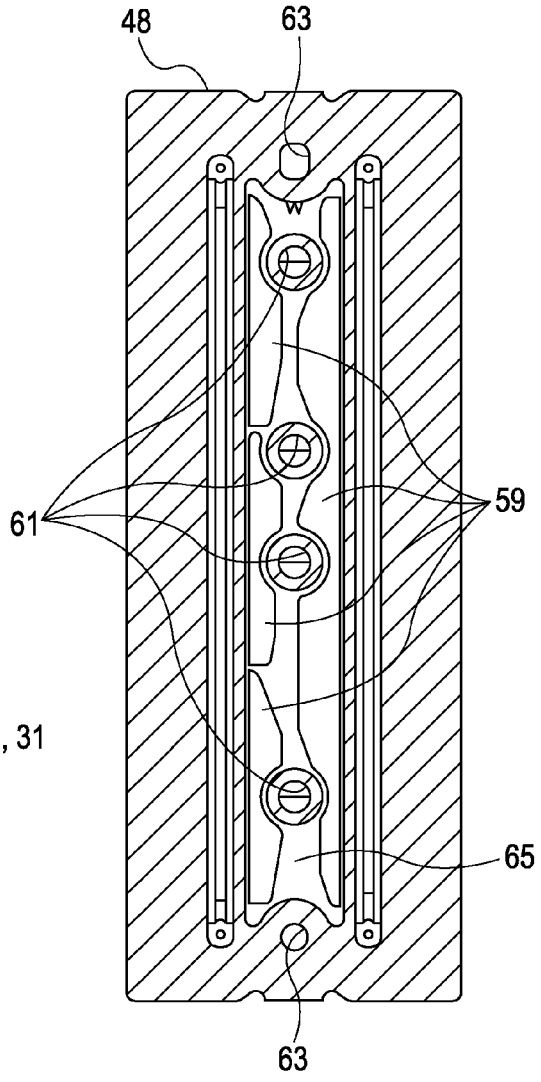
FIG. 9B is a cross-sectional view taken along the line IXB-IXB of FIG. 8A.

Next, the reinforcing member 48 will be described. FIG. 6A is a bottom view of the reinforcing member 48, and FIG. 6B is a plane view showing the channel unit 39 mounted to the reinforcing member 48. In addition, FIGS. 7A to 8C show a state where the channel unit 39 is fixed to the reinforcing member 48, where FIG. 7A is a plane view, FIG. 7B is a cross-sectional view taken along the line VIIB-VIIB of FIG. 7A, FIG. 8A is a front view, FIG. 8B is a bottom view, and FIG. 8C is a side view. Further, FIG. 9A is a cross-sectional view taken along the line IXA-IXA of FIG. 8A, and FIG. 9B is a cross-sectional view taken along the line IXB-IXB of FIG. 8B. In addition, FIG. 7A shows a state where the sealant 74 is applied to the surface of the reinforcing member 48.

The reinforcing member 48 is a plate-shaped member which is joined to the oscillation plate 51 of the channel unit 39 and has a greater stiffness than the head case body 47. For example, since the coefficient of linear expansion the head case body 47 of the resin material is greater than the coefficient of linear expansion of a substrate which configures the channel unit 39, the deformation amount increases when temperature or moisture changes. The reinforcing member 48 is interposed between the head case body 47 and the channel unit 39 for reinforcement so that the deformation of the head case body 47 does not exert a negative influence on the channel unit 39 or the oscillator unit 45. For this reason, the reinforcing member 48 preferably has a greater stiffness than the channel unit 39, and in this embodiment, is made of stainless steel with a greater thickness than the channel unit 39. In addition, as shown in FIG. 6A, the reinforcing member 48 is configured so that two rows of insertion openings 40 perforated in the plate thickness direction at places opposite to the plurality of pressure generating chambers 38 (or, the diaphragm units 58) are opened corresponding to each row of the pressure generating chambers 38. Into the insertion opening 40, the peak portion of the piezoelectric oscillator group 43 of an oscillator unit 45, described later, is inserted. In addition, to the opening circumference portion of the insertion opening 40 toward the head case body 47, the end surface of the fixing plate 42 of the oscillator unit 45 (the end surface of the piezoelectric oscillator 44 where the free end portion protrudes) is joined. Further, at the surface of the reinforcing member 48 opposite to the channel unit 39, the head case body 47 is joined in a state where a receiving void portion 46, described later, communicates with the insertion opening 40. In addition, between two rows of the insertion openings 40 of the reinforcing member 48, four penetrating channels 61 are formed in parallel so that one end communicates with the case channel 70 of the head case body 47, and the other end communicates with the ink introduction port 56 of the oscillation plate 51 (see FIGS. 6A and 6B, or the like). By doing so, the ink may be supplied from the ink cartridge 3 to each reservoir 52 via the upstream-side ink channel, the case channel 70, the penetrating channel 61, and the ink introduction port 56. In addition, the datum hole 63 is opened at both end portions of the reinforcing member 48 on the virtual line L where the penetrating channels 61 are installed in parallel (see FIG. 6A). The datum hole 63 may be arranged by the channel unit datum hole 64 formed at the channel unit 39. By inserting the positioning protrusion portion 75 of the head case body 47 into the datum holes 63 and 64, relative locations of the channel unit 39, the reinforcing member 48, and the head case body 47 are defined.

In addition, at a portion of the surface of the reinforcing member 48 at a side joined to the channel unit 39, as shown in FIGS. 6A and 9B, a concave chamber 65 is formed by depressing slightly (for example, 20 μm from a channel unit joint surface 67) at a side opposite to the corresponding channel unit 39 (the reservoir 52). The concave chamber 65 of this embodiment has an approximate rectangular region surrounded by two rows of insertion openings 40 and two datum holes 63, and in a region except for the opening circumferential portion of the penetrating channel 61, all compliance units 59 are formed in series with a size located in the forming region of the concave portion 65 over a plurality of compliance units 59, in other words, in a state of being joined to the channel unit 39, in a planar view. In addition, the surrounding of the concave chamber 65 and the opening circumferential portion of the penetrating channel 61 are formed to be in accordance with the channel unit joint surface 67 in height. By doing so, the surrounding of the concave chamber 65 is hermetically sealed, and the insertion opening 40 and the receiving void portion 46, and the penetrating channel 61 and the ink introduction port 56, may be respectively liquid-tightly connected. In addition, at the reinforcing member 48, a reinforcing member-side atmosphere opening passage 66 whose one end communicates with the concave chamber 65 to configure a part of the atmosphere opening passage 31 is formed to perforate in the plate thickness direction. One reinforcing member-side atmosphere opening passage 66 of this embodiment is installed between a penetrating channel 61 located at an end portion and a penetrating channel 61 adjacent thereto, on the virtual line L where the penetrating channels 61 are installed in parallel at the inside of the concave chamber 65 (the upper side in FIG. 6A). In addition, the other end of the reinforcing member-side atmosphere opening passage 66 communicates with the case-side atmosphere opening passage 71 formed at the head case body 47. For this reason, a series of atmosphere opening passage 31 is formed from the concave chamber 65, to the outer atmosphere of the recording head unit 2 via the reinforcing member-side atmosphere opening passage 66, the case-side atmosphere opening passage 71, the pedestal-side atmosphere opening passage 30, and the serpentine channel. By doing so, by joining the channel unit 39 to the reinforcing member 48, it is prevented that the concave chamber 65 is sealed. In addition, the reinforcing member 48 of this embodiment is configured so that the outer circumference of the side joined to the channel unit 39 (the outer circumference of the channel unit joint surface 67) is depressed slightly at a side opposite to the channel unit 39, similar to the concave chamber 65.

Next, the oscillator unit 45 will be described. The oscillator unit 45 of this embodiment includes a flexible cable 33, a piezoelectric oscillator group 43 and a fixing plate 42. The piezoelectric oscillator 44 (a kind of pressure generating element) configuring the piezoelectric oscillator group 43 divides the piezoelectric oscillation plate, which is a base material, with an extremely thin width of several tens of μm, thereby forming a comb thin in the vertical direction. The piezoelectric oscillator 44 is configured as a vertically-oscillating piezoelectric oscillator 44 which may expand or contract in the vertical direction. In addition, each piezoelectric oscillator 44 is fixed in a so-called cantilever state so that the free end portion protrudes outer than the peak rim (the end surface) of the fixing plate 42 by joining the fixing end portion onto the fixing plate 42. In addition, the peak of the free end portion of each piezoelectric oscillator 44 is inserted into the insertion opening 40 of the reinforcing member 48, and is respectively joined to the island portion 60 which configures the diaphragm unit 58 at the channel unit 39. Meanwhile, at the fixing end portion of each piezoelectric oscillator 44, the flexible cable 33 is electrically connected at a side opposite to the fixing plate 42. At the surface of the flexible cable 33, controlling IC or the like for controlling operations or the like of each piezoelectric oscillator 44 is mounted. The end portion of the flexible cable 33 opposite to the piezoelectric oscillator 44 is electrically connected to the circuit board 13. In addition, the fixing plate 42 supporting each piezoelectric oscillator 44 is configured with a metallic plate material having stiffness capable of accepting a reaction from the piezoelectric oscillator 44, and in this embodiment, it is made of stainless steel with a thickness of about 1 mm. A portion of the end surface of the fixing plate 42 toward the reinforcing member is adhered and fixed to the edge of the insertion opening 40 of the reinforcing member 48. In this embodiment, at the end surface of the fixing plate 42 opposite to the reinforcing member 48, a chamfered portion 77 whose edges are chamfered is formed at a side opposite to the piezoelectric oscillator 44, and the fixing plate 42 is fixed to the reinforcing member 48 by applying a UV-curable resin 78, which is a kind of adhesive, to the chamfered portion 77, connecting the chamfered portion 77 to the reinforcing member 48, and then curing the UV-curable resin 78 by UV irradiation.

In the recording head 14 configured as above, since the peak surface of the piezoelectric oscillator 44 is joined to the island portion 60, the capacity of the pressure generating chamber 38 may be varied by shrinking the free end portion of the piezoelectric oscillator 44. The pressure change is generated to the ink in the pressure generating chamber 38, accompanied with the capacity variation. In addition, the recording head 14 ejects (discharges) ink droplets from nozzle 36 by using the pressure variation.

The head cover 15 is a metallic member connected to the head case body 47 to protect the channel unit 39 or the head case 41. The head cover 15 is made of a thin plate member to surround the side surface of the head case 41, and the lower end is bent about 90 degrees toward the nozzle plate 49 to contact the nozzle formation surface 35. The surface of the head cover 15 not contacting the nozzle formation surface 35 is formed with a frame shape to expose the nozzle 36. In addition, at the upper end of the head cover 15, a flange portion 80 protrudes in the lateral direction so that the head cover datum hole 81 is perforated in the flange portion 80 (see FIG. 2). The head cover datum hole 81 is inserted into the head cover positioning unit 76 of the head case 41 and allows the head cover 15 be positioned (see FIG. 3). In this embodiment, two head cover datum holes 81 are respectively provided at both sides with the case unit 47*a* of the head case body 47 being interposed therebetween.

Next, a manufacturing method of the recording head 14 configured as above will be described. The manufacturing method of the recording head 14 includes a concave chamber forming process for forming the concave chamber 65 by pressing a part of the surface of the reinforcing member 48 at the channel unit joint surface 67 side in a direction opposite to the channel unit joint surface 67 by press molding (corresponding to a surface pushing unit of the present invention), a first head case joining process for joining the channel unit 39 and the reinforcing member 48, an oscillator unit fixing process for joining the oscillator unit 45 and the reinforcing member 48, and a second head case joining process for joining the head case body 47 to the reinforcing member 48. In addition, the first head case joining process and the second head case joining process correspond to the head case joining process of the present invention.

In detail, first, stainless steel which becomes the basis of the reinforcing member 48 is set to a reinforcing member forming device, not shown. In this state, the datum hole 63, the insertion opening 40, the penetrating channel 61, and the atmosphere opening passage 31 are formed by perforating in the plate thickness direction at a predetermined location by using a punch (not shown) or the like. Next, at a portion corresponding to the outer circumference of the reinforcing member 48 and the concave chamber 65, surface pushing (pressing) is performed at a side opposite to the channel unit joint surface 67 from the channel unit joint surface 67 by using a press mold (not shown) having a convex portion with a height corresponding to the depression depth of the concave chamber 65 from a flat surface (a concave chamber forming process). By doing so, together with forming the concave chamber 65, the reinforcing member 48 is formed to ensure flatness between the opening circumferential portion of the penetrating channel 61 and the channel unit joint surface 67. In detail, if a retreating amount from the channel unit joint surface 67 of the concave chamber 65 is in the range equal to or greater than 20 μm and equal to or smaller than 30 μm, the space for runout during the displacement of the compliance unit and the space for runout of an adhesive may be ensured while the required flatness of the channel unit joint surface 67 (for example, 5 μm or less) is ensured.

Next, the channel unit 39 is set to a work set platform of an alignment device, not shown. At this time, the channel unit 39 is positioned so that a positioning pin (not shown) protruding on the work set platform is inserted into the channel unit datum hole 64. In addition, the reinforcing member 48 configured as above is gripped by a gripping mechanism (not shown) of the alignment device, so that the channel unit 39 is moved to the upper portion of the reinforcing member 48. In this state, an adhesive is applied to the reinforcing member 48 or the channel unit 39. After that, the gripping mechanism is moved in the vertical direction (in a direction perpendicular to the nozzle formation surface 35), so that the positioning pin of the work set platform is inserted into the datum hole 63 of the reinforcing member 48, and the reinforcing member 48 is joined to the channel unit 39 (the first head case joining process). In addition, the gripping mechanism supports the reinforcing member 48 in a state of being connected to the channel unit 39 until the adhesive is cured, and after that, if the adhesive is cured, the gripping of the reinforcing member 48 by the gripping mechanism is released.

Next, the oscillator unit 45 (the fixing plate 42) is gripped by the gripping mechanism, so that the oscillator unit 45 is moved to the upper portion of the channel unit 39 to which the reinforcing member 48 mounted to the work set platform is joined. At this time, relative locations of the oscillator unit 45 and the channel unit 39 are checked by using a camera or the like for the alignment device, so that the gripping mechanism or the work set platform is moved, and the channel unit 39 of the oscillator unit 45 is positioned. In this state, an adhesive is applied to the peak portion of each piezoelectric oscillator 44, and an UV-curable resin 78 is applied to the chamfered portion 77 of the fixing plate 42. After that, each oscillator unit 45 is moved by each gripping mechanism in a direction perpendicular to the nozzle formation surface 35, so that the peak portion of each piezoelectric oscillator 44 is inserted into the insertion opening 40 of the reinforcing member 48 to contact the island portion 60, and the fixing plate 42 contacts the edge of the insertion opening 40 of the reinforcing member 48. In this state, UV is irradiated to the UV-curable resin 78 applied to each fixing plate 42 to cure the UV-curable resin 78, and the fixing plate 42 is fixed to the reinforcing member 48, so that the gripping of the fixing plate 42 by the gripping mechanism is released. In addition, after some time, the adhesive between the island portion 60 and the peak portion of the piezoelectric oscillator 44 is cured, so that both of them are fixed (the oscillator unit fixing process).

After that, the head case body 47 is gripped by the gripping mechanism, so that the head case body 47 is moved to the upper portion of the channel unit 39 to which the reinforcing member 48 and the oscillator unit 45 are joined. In this state, a sealant 74 is applied to a location opposite to the sealant adhering portion 73 of the head case body 47 of the reinforcing member 48 (see FIG. 7A). After that, the head case body 47 is moved toward the reinforcing member 48 in the vertical direction, so that a part of the oscillator unit 45 is received in the receiving void portion 46, and the positioning protrusion portion 75 of the head case body 47 is inserted into the datum hole 63 of the reinforcing member 48 and the datum hole 63 of the channel unit 39, so that the reinforcing member 48 is joined to the head case body 47 (the second head case joining process). In addition, after the head case 41 to which the channel unit 39 and the oscillator unit 45 are connected is detached from the alignment device, the head cover 15 approaches from the channel unit 39 and is positioned at the head case body 47. In this way, the recording head 14 of this embodiment may be prepared.

As described above, in the recording head 14 of this embodiment, since the concave chamber 65 is formed over a plurality of compliance units 59, if a single atmosphere opening passage 31 communicating with the concave chamber 65 is formed, each compliance unit 59 may be opened to the atmosphere, and so it is not required to form a plurality of atmosphere opening passages 31. By doing so, the deterioration of the strength of the head case 41 may be suppressed, which suppresses the oscillation generated by the operation of the piezoelectric oscillator 44 from transferring to another piezoelectric oscillator 44 via the head case 41. As a result, a crosstalk may be suppressed. In addition, since it is sufficient that a single atmosphere opening passage 31 is formed, the degree of design freedom the recording head may be enhanced. In addition, since the head case 41 of this embodiment is equipped with the reinforcing member 48 reinforcing the channel unit 39 at the adhesion surface side with the channel unit 39, it is possible to suppress deformation of the channel unit 39, caused by stress generated by deformation of the head case 41 (for example, the case where the head case body 47 made of a resin is swollen under a high humidity environment or the like). Further, the strength of the head case 41 may be enhanced. In addition, since the channel resistance of a part (serpentine channel) of the atmosphere opening passage 31 is configured to be greater than a channel resistance of another portion, it is possible to suppress gas from diffusing in the atmosphere opening passage 31, so that it is possible to suppress the moisture of the liquid in the reservoir 52 from penetrating the resin film 55 and evaporating in the atmosphere opening passage 31. As a result, the variation of the liquid ejection characteristic caused by gradual increase of the liquid in the channel unit 39 may be suppressed. In addition, since a part of the surface of the reinforcing member 48 toward the channel unit joint surface 67 is pressed at a side opposite to the channel unit joint surface 67 by press molding to form the concave chamber 65, the recording head having the concave chamber 65 may be easily manufactured.

In addition, the present invention may be applied to, for example, a display manufacturing device for manufacturing a color filter such as a liquid crystal display, an electrode manufacturing device for forming an electrode such as an organic EL (Electro Luminescence) display, a FED (Field Emission Display) or the like, a tip manufacturing device for manufacturing a biochip (a biochemical element), a micropipette for accurately supplying an extremely small amount of test solution or the like.

The entire disclosure of Japanese Patent Application No. 2011-022568, filed Feb. 4, 2011 is expressly incorporated by reference herein.

What is claimed is:

1. A liquid ejecting head, comprising:

a channel unit having a plurality of pressure chambers respectively communicating with a plurality of nozzles opened to a nozzle formation surface, a plurality of reservoirs for supplying liquid to at least one of the plurality of pressure chambers, and a plurality of compliance units formed by partitioning at least a part of the surface of each reservoir opposite to the nozzle formation surface by a film member; and a head case joined to a surface of the channel unit opposite to the nozzle formation surface, wherein a concave chamber formed by depressing a part of a surface thereof, which is joined to the channel unit, in a side opposite to the reservoir and a single atmosphere opening passage whose one end communicates with the concave chamber and the other end is opened to the atmosphere are formed at the head case, wherein the single atmosphere opening passage is connected to the atmosphere through a serpentine channel, and wherein the concave chamber is formed in series over the plurality of compliance units.

2. The liquid ejecting head according to claim 1, wherein the head case has a reinforcing member provided at a joined surface side with the channel unit to reinforce the channel unit, and wherein the concave chamber is formed at a joined surface side of the reinforcing member with the channel unit.

3. The liquid ejecting head according to claim 1, wherein a channel resistance of a part of the atmosphere opening passage is greater than a channel resistance of another part of the atmosphere opening passage.

4. A liquid ejecting apparatus having the liquid ejecting head according to claim 1.

5. A liquid ejecting apparatus having the liquid ejecting head according to claim 2.

6. A liquid ejecting apparatus having the liquid ejecting head according to claim 3.

7. A method for manufacturing a liquid ejecting head which includes a channel unit having a plurality of pressure chambers respectively communicating with a plurality of nozzles opened to a nozzle formation surface, a plurality of reservoirs for supplying liquid to at least one of the plurality of pressure chambers, and a plurality of compliance units formed by partitioning at least a part of the surface of each reservoir opposite to the nozzle formation surface by a film member, and a head case joined to a surface of the channel unit opposite to the nozzle formation surface, in which a concave chamber formed in series over the plurality of compliance units by depressing a part of a surface thereof, which is joined to the channel unit, in a side opposite to the reservoir and a single atmosphere opening passage whose one end communicates with the concave chamber and the other end is opened through a serpentine channel to the atmosphere are formed at the head case, the method comprising:

pressing a part of a surface of the head case at a channel unit joint surface side to a side opposite to the channel unit joint surface by a surface pushing unit to form the concave chamber; and joining the channel unit and the head case.

8. The method for manufacturing a liquid ejecting head according to claim 7, wherein the head case has a reinforcing member provided at a joined surface side with the channel unit to reinforce the channel unit, and wherein, in the pressing a part, the concave chamber is formed at a joined surface side of the reinforcing member with the channel unit.

9. A liquid ejecting head, comprising:

a channel unit having a plurality of pressure chambers respectively communicating with a plurality of nozzles opened to a nozzle formation surface, a plurality of reservoirs for supplying liquid to at least one of the plurality of pressure chambers, and a plurality of compliance units formed by partitioning at least a part of the surface of each reservoir opposite to the nozzle formation surface by a film member; and a head case joined to a surface of the channel unit opposite to the nozzle formation surface, the head case having a concave chamber formed by depressing a part of a surface joined to the channel unit, an atmosphere opening passage whose one end communicates with the concave chamber and the other end is opened to the atmosphere, and a plurality of penetrating channels communicated with the plurality of reservoirs and supplying liquid to the plurality of reservoirs, wherein the single atmosphere opening passage is connected to the atmosphere through a serpentine channel, and wherein the concave chamber is formed in series over the plurality of compliance units and the plurality of penetrating channels are surrounded by the concave chamber at a side of the surface joined to the channel unit.

10. A liquid ejecting head, comprising:

a channel unit having a plurality of pressure chambers respectively communicating with a plurality of nozzles opened to a nozzle formation surface, a plurality of reservoirs for supplying liquid to at least one of the plurality of pressure chambers, and a plurality of compliance units formed by partitioning at least a part of the surface of each reservoir opposite to the nozzle formation surface by a film member; and a head case joined to a surface of the channel unit opposite to the nozzle formation surface, the head case having a concave chamber formed by depressing a part of a surface joined to the channel unit, an atmosphere opening passage whose one end communicates with the concave chamber and the other end is opened to the atmosphere, and two insertion openings in which a oscillator unit is inserted respectively, the oscillator unit varies the capacity of each of the plurality of pressure chambers, wherein the single atmosphere opening passage is connected to the atmosphere through a serpentine channel, and wherein the concave chamber is formed in series over the plurality of compliance units and the concave chamber is arranged between the two insertion openings.

11. The liquid ejecting head according to claim 1, wherein at least a part of the plurality of reservoirs is arranged orthogonally in relation to the nozzle formation surface.

12. The method for manufacturing a liquid ejecting head according to claim 7, wherein at least a part of the plurality of reservoirs is arranged orthogonally in relation to the nozzle formation surface.

13. The liquid ejecting head according to claim 9, wherein at least a part of the plurality of reservoirs is arranged orthogonally in relation to the nozzle formation surface.

14. The liquid ejecting head according to claim 10, wherein at least a part of the plurality of reservoirs is arranged orthogonally in relation to the nozzle formation surface.

15. The liquid ejecting head according to claim 1, wherein the plurality of pressure chambers is arranged orthogonally in relation to the plurality of nozzles.

16. The liquid ejecting head according to claim 7, wherein the plurality of pressure chambers is arranged orthogonally in relation to the plurality of nozzles.

17. The liquid ejecting head according to claim 9, wherein the plurality of pressure chambers is arranged orthogonally in relation to the plurality of nozzles.

18. The liquid ejecting head according to claim 10, wherein the plurality of pressure chambers is arranged orthogonally in relation to the plurality of nozzles.

19. The liquid ejecting head according to claim 1, wherein the reinforcing member and a lower surface of the head case are joined over an equal area.

20. The method for manufacturing a liquid ejecting head according to claim 8, wherein the reinforcing member and a lower surface of the head case are joined over an equal area.

* * * * *